US009627154B2

(12) United States Patent
Naka et al.

(10) Patent No.: US 9,627,154 B2
(45) Date of Patent: Apr. 18, 2017

(54) ELECTROMAGNETIC CONTACTOR

(71) Applicant: FUJI ELECTRIC FA COMPONENTS & SYSTEMS CO., LTD., Chuo-ku, Tokyo (JP)

(72) Inventors: Yasuhiro Naka, Kounosu (JP); Kouetsu Takaya, Kounosu (JP); Kenji Suzuki, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/677,017

(22) Filed: Apr. 2, 2015

(65) Prior Publication Data

US 2015/0213969 A1 Jul. 30, 2015

Related U.S. Application Data

(63) Continuation of application No. PCT/JP2013/005820, filed on Sep. 30, 2013.

(30) Foreign Application Priority Data

Nov. 15, 2012 (JP) ..... 2012-251570

(51) Int. Cl.
*H01H 9/02* (2006.01)
*H01H 13/04* (2006.01)
(Continued)

(52) U.S. Cl.
CPC ..... *H01H 1/64* (2013.01); *H01H 50/546* (2013.01); *H01H 50/20* (2013.01); *H01H 51/065* (2013.01); *H01H 2050/025* (2013.01)

(58) Field of Classification Search
CPC H01H 9/02; H01H 9/44; H01H 13/04; H01H 19/04; H01H 21/04; H01H 50/38; H01H 50/00; H01H 50/02; H01H 50/54; H01H 1/64; H01H 1/66; H01H 50/04; H01H 50/08; H01H 50/546; H01H 3/28;
(Continued)

(56) References Cited

U.S. PATENT DOCUMENTS 8,274,347 B2 * 9/2012 Eum ..... H01H 9/341 335/156
2009/0237191 A1 9/2009 Yano et al.
2013/0113580 A1 5/2013 Naka et al.

FOREIGN PATENT DOCUMENTS

JP H06-203725 A 7/1994
JP H07-065683 A 3/1995
(Continued)

OTHER PUBLICATIONS

PCT, "International Search Report for International Application No. PCT/JP2013/005820".

*Primary Examiner* — Anthony R. Jimenez
(74) *Attorney, Agent, or Firm* — Manabu Kanesaka

(57) ABSTRACT

An electromagnetic contactor includes a contact device having a pair of fixed contacts disposed to maintain a predetermined distance and a movable contact disposed so as to contact to and detach from the pair of fixed contacts. An insulating cover, which covers the pair of fixed contacts except for contact portions that contact the movable contact and covers an inner surface of an insulating plate that fixes and holds the fixed contacts, is mounted on the pair of fixed contacts.

4 Claims, 9 Drawing Sheets

(51) Int. Cl.

| | |
|---|---|
| ***H01H 19/04*** | (2006.01) |
| ***H01H 21/04*** | (2006.01) |
| ***H01H 1/64*** | (2006.01) |
| ***H01H 50/54*** | (2006.01) |
| *H01H 50/20* | (2006.01) |
| *H01H 51/06* | (2006.01) |
| *H01H 50/02* | (2006.01) |

(58) Field of Classification Search
CPC ..... H01H 45/14; H01H 71/521; H01H 67/02; H01H 9/30; H01H 9/341; H01H 9/0264; H01H 9/342; H02B 1/06
USPC ..... 335/201, 331, 126; 200/181, 19.06, 200/50.08, 400, 109, 430, 440, 452, 457, 200/460, 238, 244, 248–250; 337/78, 101
See application file for complete search history.

(56) References Cited

FOREIGN PATENT DOCUMENTS

| | | | |
|---|---|---|---|
| JP | 2007-305468 | A | 11/2007 |
| JP | 2012-028252 | A | 2/2012 |

* cited by examiner

Fig. 4(a)
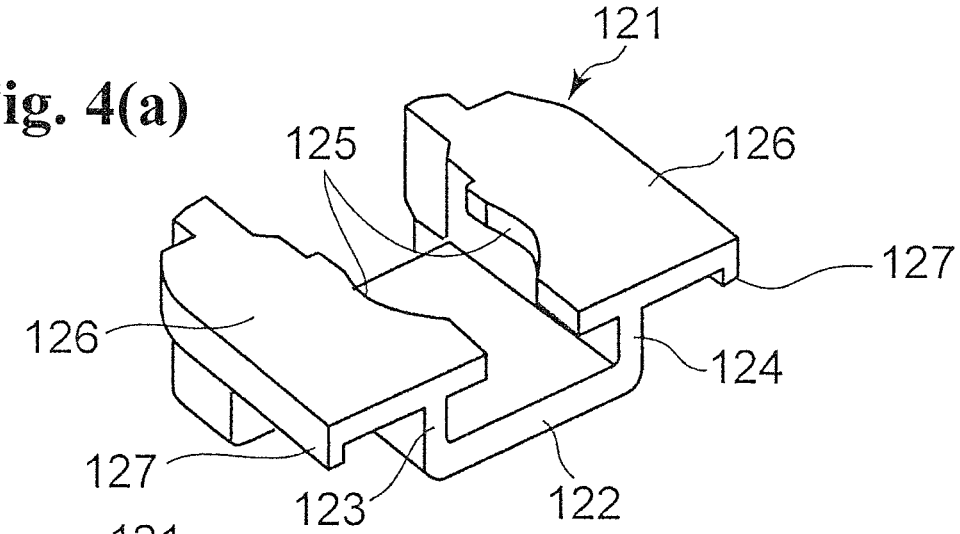
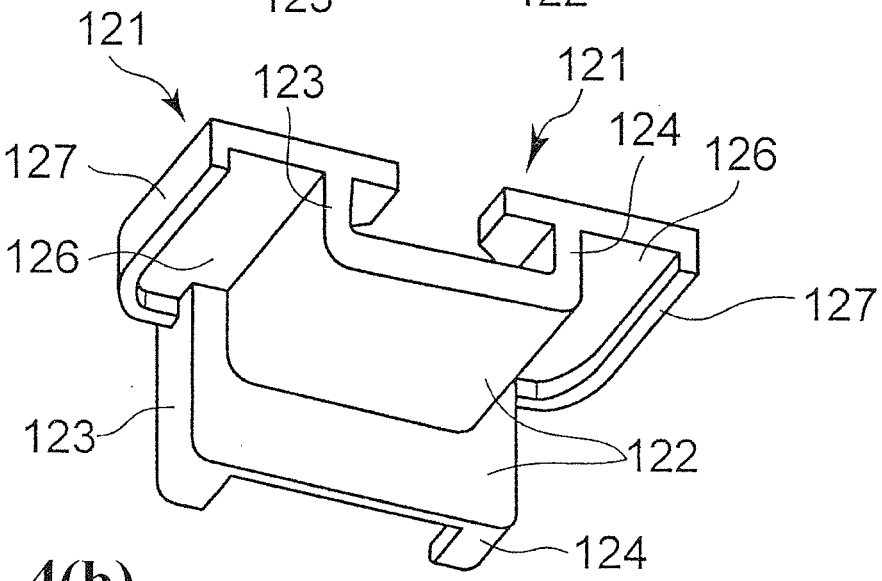
Fig. 4(b)

ELECTROMAGNETIC CONTACTOR

RELATED APPLICATIONS

The present application is a Continuation Application of International Application No. PCT/JP2013/005820 filed Sep. 30, 2013, which claims a priority from Japanese Application No. 2012-251570 filed Nov. 15, 2012.

TECHNICAL FIELD

The present invention relates to an electromagnetic contactor having a pair of fixed contacts disposed to maintain a predetermined interval and a movable contact disposed so as to be connectable to and detachable from the fixed contacts.

BACKGROUND ART

For example, an electromagnetic contactor such that a contact mechanism has a fixed contact and movable contact interposed in a conduction path, wherein the contact mechanism includes the fixed contact formed in a C-shape (U shape, or J-shape), and when energizing, a Lorentz force is generated to oppose an electromagnetic repulsion force generated in the contact opening direction between the fixed contact and movable contact, has been proposed as an electromagnetic contactor that carries out opening and closing of a current path (for example, refer to PTL 1).

CITATION LIST

Patent Literature

PTL 1: JP-A-2012-28252

SUMMARY OF INVENTION

Technical Problem

Herein, in the heretofore known example described in PTL 1, a pair of fixed contacts are formed in a C-shape and disposed in a state wherein opened portions oppose each other, a movable contact is disposed in an intermediate portion of the C-shapes, and by pulling the movable contact down by an electromagnet, the movable contact is brought into contact with the pair of fixed contacts at a predetermined contact pressure.

However, in the heretofore known example, the movable contact is disposed in an intermediate portion of the C-shaped fixed contacts. Because of this, when shifting from a closed contact state wherein the movable contact contacts the fixed contacts, to an opened contact state wherein the movable contact is separated from the fixed contacts, there is a problem that an arc to be generated moves above the fixed contacts, and the leading end of the arc is short-circuited in a portion other than contact portions of the fixed contacts.

In order to resolve this problem, it is conceivable that portions other than the contact portions of the fixed contacts are covered with an insulating cover. However, even when covering only the fixed contacts with an insulating cover, the fixed contacts are supported by an insulating plate, so when assembling, the necessary clearance is provided between the insulating plate and insulating cover, and clearance also occurs between the insulating cover and insulating plate due to part variation. Because of this, there is an unresolved problem that an extended arc infiltrates through the clearance, and short-circuits with the upper portion of the fixed contacts, as a result, the arc voltage drops, and arc interruption is incomplete.

Therefore, the invention, having been contrived to focus on the unresolved problem of the heretofore known example, has a purpose of providing an electromagnetic contactor such that it is possible to reliably prevent contact other than between an arc and a contact portion of a fixed contact, thus reliably extinguishing the arc.

Solution to Problem

In order to achieve the heretofore described purpose, in a first aspect of an electromagnetic contactor according to the invention, the electromagnetic contactor includes a pair of fixed contacts disposed to maintain a predetermined distance and a movable contact disposed so as to connect to and detach from the pair of fixed contacts, wherein an insulating cover, which covers the pair of fixed contacts except for contact portions that contact the movable contact and covers an inner surface of an insulating plate that fixes and holds the fixed contacts, is mounted on the pair of fixed contacts.

According to this configuration, the fixed contacts except for the contact portions that contact the movable contact, are covered with an insulating cover, as a result, even if an arc is generated when the movable contact is separated from the fixed contacts, it is possible to reliably prevent the end portion of the arc from moving above the fixed contacts from an engaged state wherein the movable contact contacts the fixed contacts. Also, as the insulating cover covers the inner surface of the insulating plate that fixes and holds the fixed contacts, it is possible to reliably prevent the arc from reaching a fixed contact support portion of the insulating plate. Consequently, it is possible to reliably prevent the leading end of an extended arc from contacting the fixed contacts, the arc from short-circuiting, and the arc voltage from dropping.

Also, in a second aspect of the electromagnetic contactor according to the invention, the pair of fixed contacts include support conductor portions supported to maintain a predetermined interval by the upper surface of a contact housing case, and C-shaped portions formed in a C-shape, each having an upper plate portion linked to an end portion of the support conductor portion inside the contact housing case, an intermediate plate portion extending downward from a side of the upper plate portion opposite to that of the other support conductor portion, and a lower plate portion extending from a lower end of the intermediate plate portion to the other support conductor portion side and having the contact portion formed on an upper surface thereof. Further, the insulating cover includes a cover main bodies, which expose at least the contact portions of the C-shaped portion and cover surfaces opposing the movable contact and side surfaces adjacent to each of the surfaces opposing the movable contact, and extended portions extending along a line of the inner surface of the insulating plate from side surface portions of each of the cover main bodies that cover side surfaces of each of the upper plate portions.

According to this configuration, the fixed contacts are formed as C-shaped portions, as a result, even if an electromagnetic repulsion force is generated in the contact portions of the fixed contacts and movable contact when the contact device is in a closed contact state, it is possible to generate a Lorentz force opposing the electromagnetic repulsion force in the C-shaped portions. As only the contact portions are exposed by the insulating cover when an arc is generated between the fixed contacts and movable contact, when the movable contact subsequently separates from the fixed contacts, it is possible to reliably prevent change of the current path by moving above the fixed contacts, and possible to reliably prevent the arc from reaching a fixed contact support portion of the insulating plate.

Also, in a third aspect of the electromagnetic contactor according to the invention, the insulating cover includes L-shaped portions that cover inner surfaces of the upper plate portion and the intermediate plate portions of the C-shaped portions of the pair of fixed contacts, side plate portions extending from side edges of the L-shaped portions so as to cover side surfaces of the C-shaped portions, fitting portions extending inward from upper ends of the side plate portions opposing the support conductor portions and fitted onto small diameter portions formed on the support conductor portions, and the extended portions extending from the upper ends of the side plate portions along the inner surface of the insulating plate, respectively.

According to this configuration, it is possible to install the insulating cover in the fixed contacts simply by fitting the fitting portions of the insulating cover onto small diameter portions formed on the support conductor portions, and thus possible to easily carry out installation of the insulating cover.

Advantageous Effects of Invention

According to the invention, when each of the fixed contacts has an L-shaped portion or C-shaped portion, and a Lorentz force is generated to oppose an electromagnetic repulsion force in an engaged state; the fixed contacts except for the contact portions are covered with an insulating cover, as a result, it is possible to reliably prevent an arc generated when shifting from an engaged state to a released state, from moving above the fixed contacts. Also, it is possible to reliably prevent the leading end of the arc from reaching a support portion of the insulating plate supporting the fixed contacts, and also prevent the arc from short-circuiting in a portion other than a contact portion. Consequently, it is possible to stably extend the arc even when the interruption voltage rises, and thus possible to reliably carry out arc extinguishing, and reliably interrupt the current.

BRIEF DESCRIPTION OF DRAWINGS

FIGS. 4(*a*) and 4(*b*) are diagrams, each showing an insulating cover of a contact mechanism, wherein FIG. 4 (*a*) is a perspective view relative to the upper side and FIG. 4 (*b*) is a perspective view relative to the lower side.

DESCRIPTION OF EMBODIMENTS

Hereafter, a description will be given, based on the drawings, of an embodiment of the invention.

Figure 1:
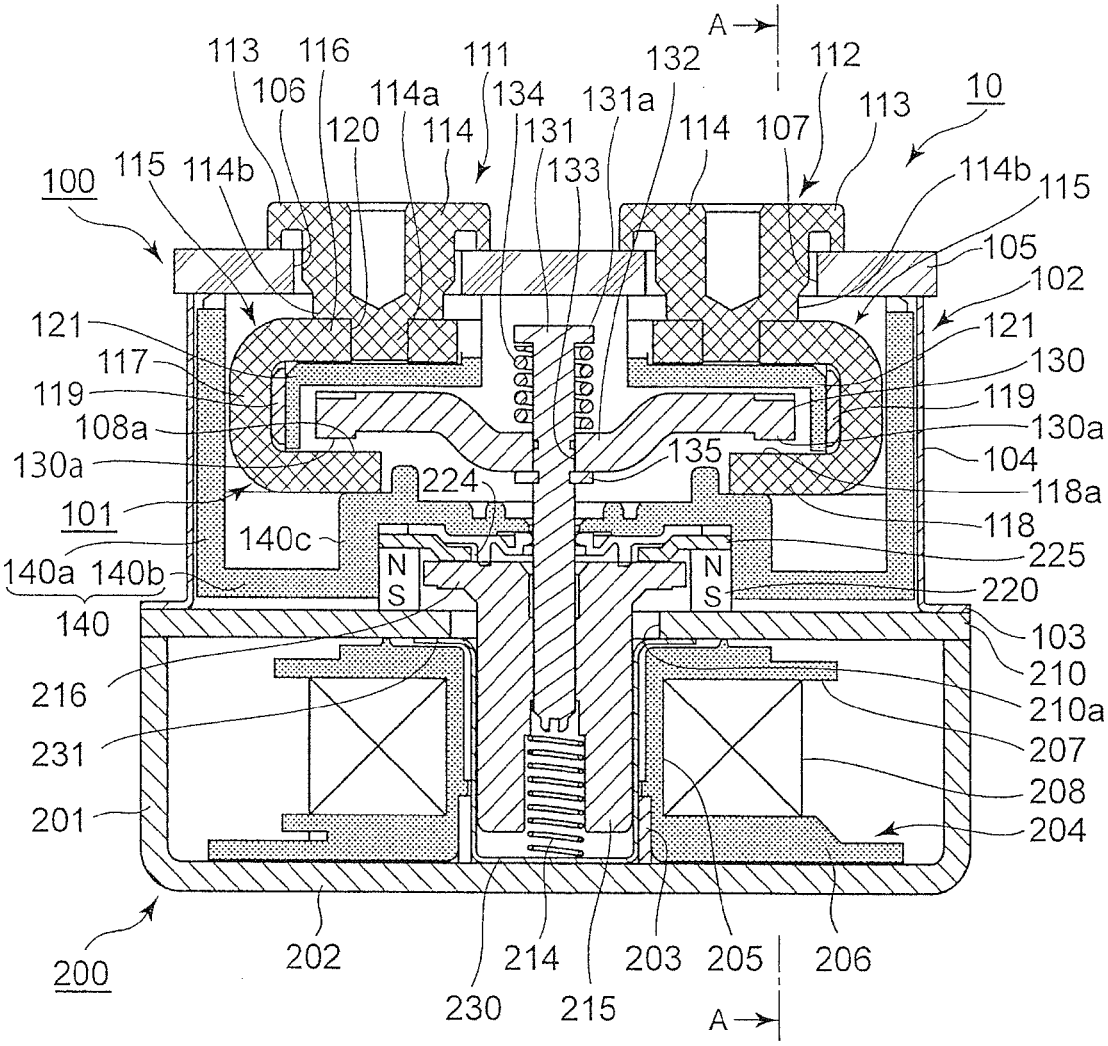
FIG. 1 is a sectional view showing a first embodiment of an electromagnetic contactor according to the invention.
Figure 2B:
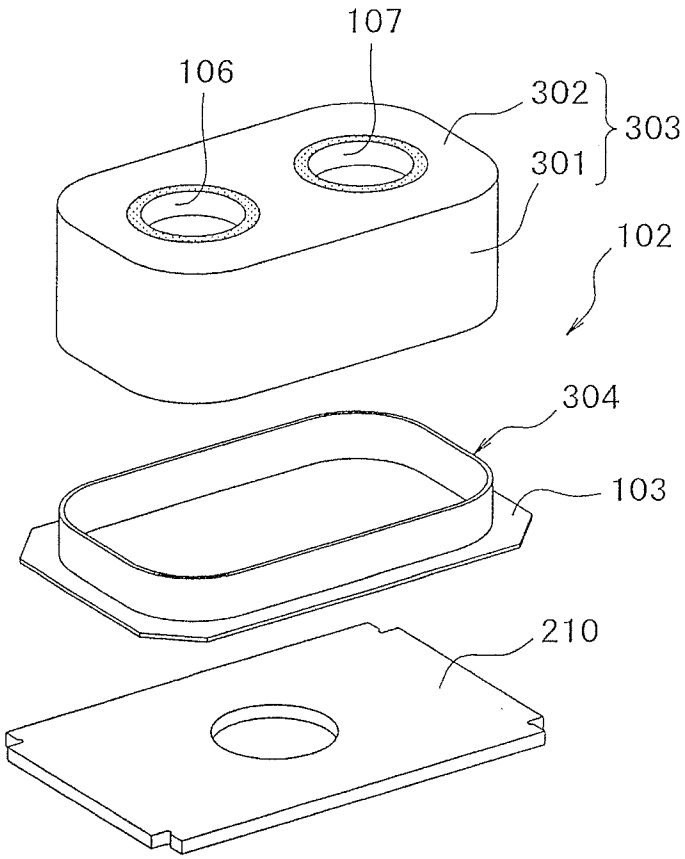
FIGS. 2(*a*) and 2(*b*) are exploded perspective views, each showing a contact housing case of FIG. 1.
Figure 2A:
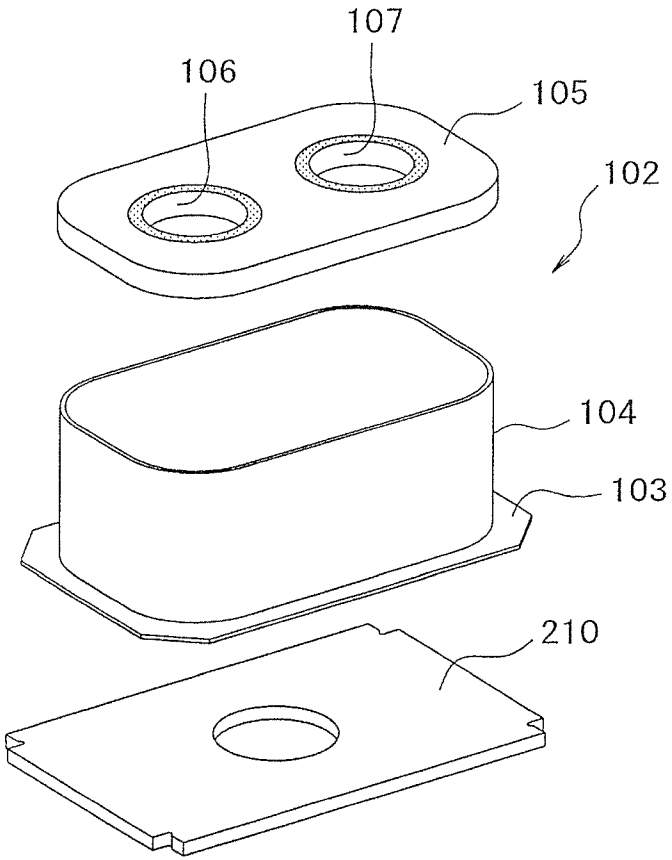

FIG. 1 is a sectional view showing an example of an electromagnetic contactor according to the invention, while FIG. 2 is an exploded perspective view of a contact housing case. In FIG. 1 and FIG. 2, 10 is an electromagnetic contactor. The electromagnetic contactor 10 includes a contact device 100 in which a contact mechanism is disposed, and an electromagnet unit 200 that drives the contact device 100.

The contact device 100 has a contact housing case 102 that houses a contact mechanism 101, as clearly shown in FIG. 1 and FIG. 2. The contact housing case 102 includes a metal tubular body 104 having a flange portion 103 protruding outward on a metal lower end portion thereof, and a fixed contact support insulating base plate 105 formed of a plate-like ceramic insulating base plate that closes off the upper end of the metal tubular body 104, as shown in FIG. 2(*a*).

The metal tubular body 104 includes the flange portion 103 seal-joined and fixed to an upper magnetic yoke 210 of the electromagnet unit 200, to be described hereafter.

Also, through holes 106 and 107 through which a pair of fixed contacts 111 and 112 are inserted, to be described hereafter, are formed to maintain a predetermined interval in a central portion of the fixed contact support insulating base plate 105. A metalizing process is performed around the through holes 106 and 107 on the upper surface side of the fixed contact support insulating base plate 105, and in a position on the lower surface side that comes into contact with the tubular body 104. Further, the fixed contact support insulating base plate 105 is brazed to the upper surface of the tubular body 104.

The contact mechanism 101, as shown in FIG. 1, includes the pair of fixed contacts 111 and 112 inserted through and fixed in the through holes 106 and 107 of the fixed contact support insulating base plate 105 of the contact housing case 102. Each of the fixed contacts 111 and 112 includes a support conductor portion 114, having a flange portion 113 protruding outward on an upper end thereof, inserted through the through holes 106 and 107 of the fixed contact support insulating base plate 105, and a C-shaped portion 115, the inner side of which is opened, linked to the support conductor portion 114 and disposed on the lower surface side of the fixed contact support insulating base plate 105.

The C-shaped portion 115 includes an upper plate portion 116, an intermediate plate portion 117, and a lower plate portion 118. The upper plate portion 116 extends to the outer side along the line of the lower surface of the fixed contact support insulating base plate 105. The intermediate plate portion 117 extends downward from the outer side end portion of the upper plate portion 116. The lower plate portion 118 extends from the lower end side of the intermediate plate portion 117, parallel to the upper plate portion 116, to the inner side, that is, in a direction facing each of the fixed contacts 111 and 112. Further, the C-shaped portion 115 is formed in a C-shape wherein the upper plate portion 116 is added to an L-shape formed by the intermediate plate portion 117 and lower plate portion 118.

Herein, the support conductor portion 114 and C-shaped portion 115 are fixed by, for example, brazing in a state which a pin 114*a* formed protruding on the lower end surface of the support conductor portion 114 is inserted into a through hole 120 formed in the upper plate portion 116 of the C-shaped portion 115. The support conductor portion 114 and C-shaped portion 115, not being limited to brazing, may be fixed such that the pin 114*a* is fitted into the through hole 120, or an external thread is formed on the pin 114*a* and an internal thread formed in the through hole 120, and the two are screwed together.

Also, a magnetic plate 119 formed in a C-shape in plan view is mounted so as to cover the inner surface of the intermediate plate portion 117 of the C-shaped portions 115 of the fixed contacts 111 and 112. By disposing the magnetic plate 119 so as to cover the inner surface of the intermediate plate portion 117, in this way, it is possible to shield against a magnetic field generated by current flowing through the intermediate plate portion 117.

It is sufficient to shield against a magnetic field generated by current flowing through the intermediate plate portion 117, and the magnetic plate 119 may also be formed so as to cover the periphery of the intermediate plate portion 117.

Figure 3:
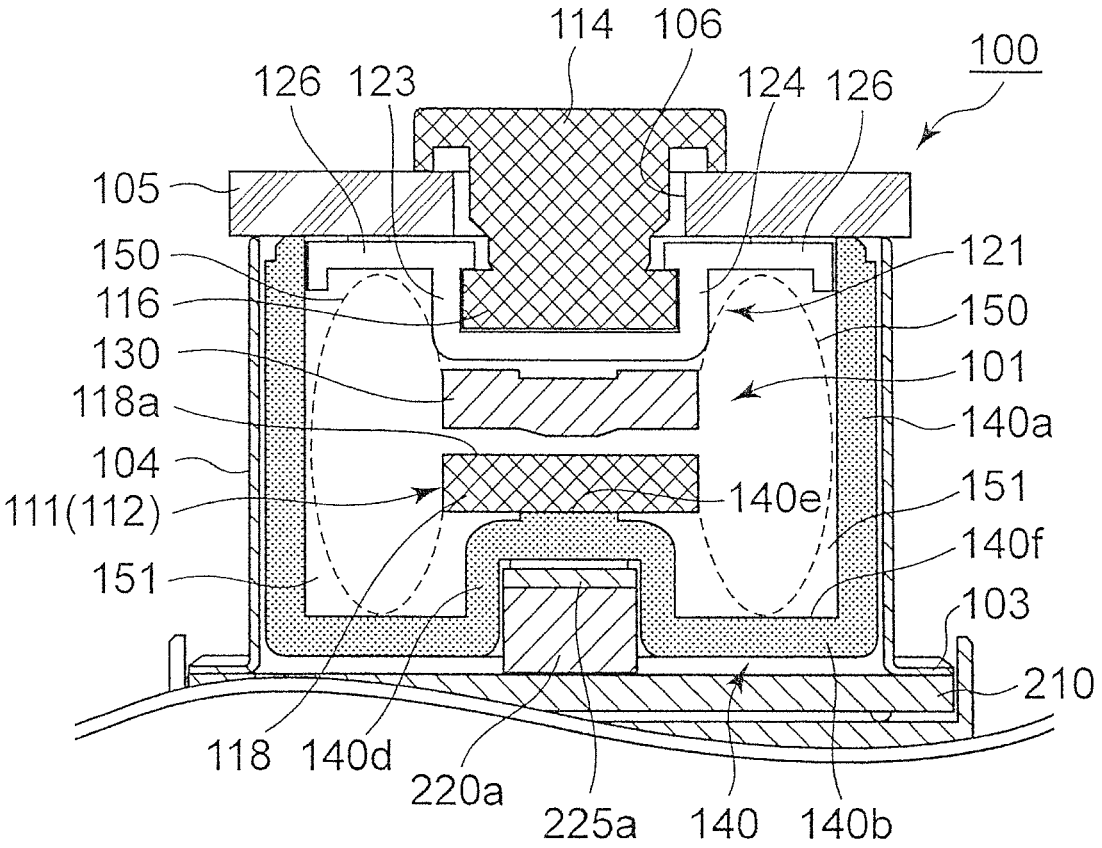
FIG. 3 is a sectional view along an A-A line of FIG. 1.

Further, an insulating cover 121, made of a synthetic resin material, that regulates arc generation is mounted in the C-shaped portion 115 of each of the fixed contacts 111 and 112. The insulating cover 121 covers the inner peripheral surfaces of the upper plate portion 116 and intermediate plate portion 117 of the C-shaped portion 115, and also covers the inner surface of the fixed contact support insulating base plate 105, as shown in FIG. 3 and FIGS. 4(*a*) and (*b*).

The insulating cover 121 includes an L-shaped plate portion 122, side plate portions 123 and 124, fitting portions 125, and extended portions 126. The L-shaped plate portion 122 is disposed so as to follow the inner surfaces of the upper plate portion 116 and intermediate plate portion 117. The side plate portions 123 and 124 extend upward and outward from each of front and back end portions of the L-shaped plate portion 122, and cover side surfaces of the upper plate portion 116 and intermediate plate portion 117 of the C-shaped portion 115. The fitting portions 125 are formed inward from the upper ends of the side plate portions 123 and 124, and fit onto a small diameter portion 114*b* formed on the support conductor portion 114 of the fixed contacts 111 and 112. The extended portions 126 extend to the sides opposite to those of the fitting portions 125, and cover the inner surface of the fixed contact support insulating base plate 105. Flange portions 127 to contact the inner surface of the tubular body 104 are formed on the outer peripheral side of the lower surface of the extended portions 126.

Figure 5A:
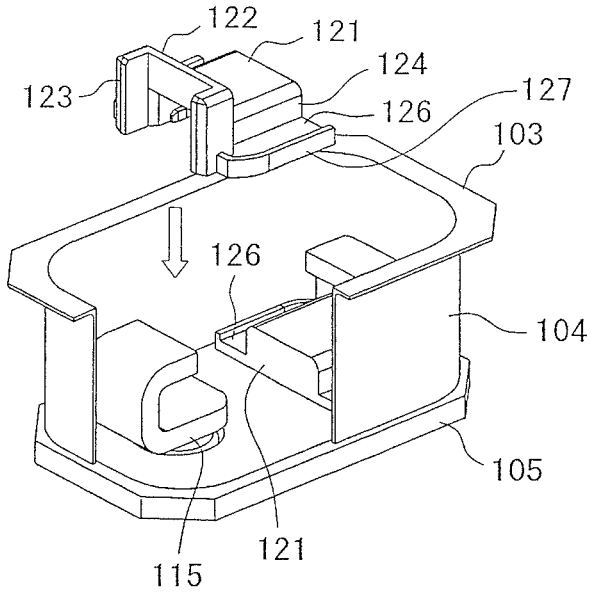
FIGS. 5(*a*), 5(*b*) and 5(*c*) are perspective views, each showing an insulating cover mounting method.
Figure 5B:
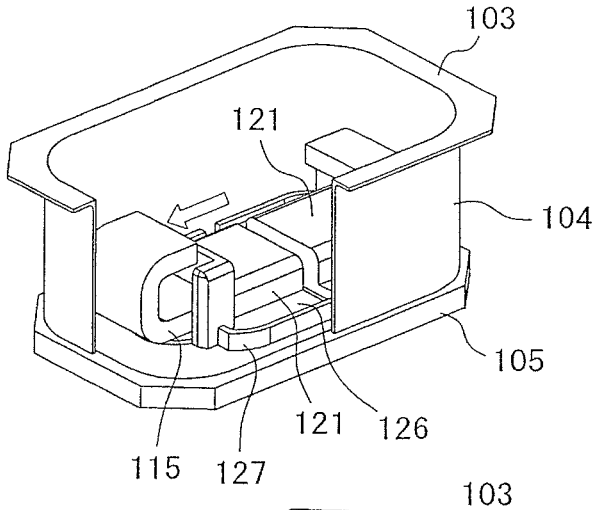
Figure 5C:
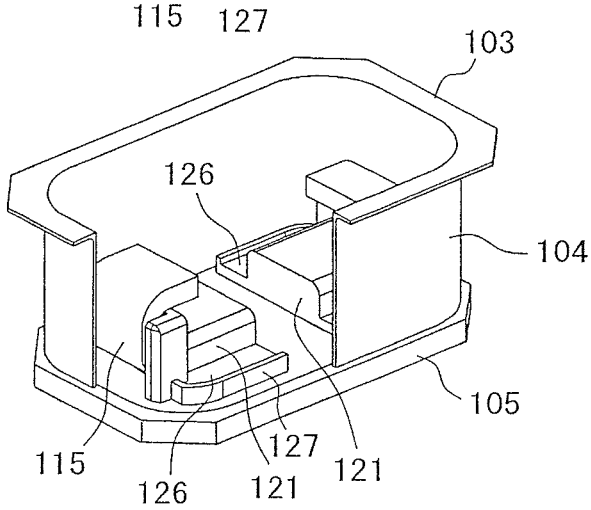

Further, the mounting of the insulating cover 121 into the fixed contacts 111 and 112 is carried out with the contact housing case 102 after the fixed contacts 111 and 112 are installed in a state wherein the fixed contact support insulating base plate 105 is on the lower side, as shown in, for example, FIG. 5(*a*).

Firstly, the insulating cover 121 is inserted between the fixed contacts 111 and 112 from an upper aperture portion, in a state reversing the insulating cover 121 vertically to that of FIGS. 4(*a*) and (*b*).

Next, in a state wherein the fitting portions 125 and extended portions 126 are parallel to the fixed contact support insulating base plate 105, as shown in FIG. 5(*b*), the fitting portions 125 are engaged with and fixed to the small diameter portion 114*b* of the support conductor portions 114 of the fixed contacts 111 and 112 by the insulating cover 121 being pushed to the outer side, as shown in FIG. 5(*c*).

By mounting the insulating cover 121 in the C-shaped portions 115 of the fixed contacts 111 and 112, in this way, only the upper surface side of the lower plate portion 118 of the inner peripheral surface of the C-shaped portion 115 is exposed, and becomes a contact portion 118*a*.

Further, a movable contact 130 is disposed such that the two end portions are disposed in the C-shaped portions 115 of the fixed contacts 111 and 112. The movable contact 130 is supported by a connecting shaft 131 fixed to a movable plunger 215 of the electromagnet unit 200, to be described hereafter. The movable contact 130 includes a central portion in the vicinity of the connecting shaft 131 protruding downward, whereby a depressed portion 132 is formed, and a through hole 133 through which the connecting shaft 131 is inserted, is formed in the depressed portion 132, as shown in FIG. 1.

A flange portion 131*a* protruding outward is formed on the upper end of the connecting shaft 131. In order to mount the movable contact 130 on the connecting shaft 131, firstly, in a state that the lower end side of the connecting shaft 131 is inserted through a contact spring 134, the connecting shaft 131 is inserted through the through hole 133 of the movable contact 130. Further, the upper end of the contact spring 134 is brought into contact with the flange portion 131*a*, the movable contact 130 is put into a pushed up state so as to obtain a predetermined biasing force from the contact spring 134, and in this state, the movable contact 130 is positioned on the connecting shaft 131 with, for example, a C-ring 135.

The movable contact 130, in a released state, is in a state wherein both ends of contact portions 130*a* and the contact portions 118*a* of the lower plate portions 118 of the C-shaped portions 115 of the fixed contacts 111 and 112 are separated from each other with a predetermined interval. Also, the movable contact 130 is set such that, in an engaged position, both ends of the contact portions come into contact with the contact portions 118*a* of the lower plate portions 118 of the C-shaped portions 115 of the fixed contacts 111 and 112 at a predetermined contact pressure from the contact spring 134.

Figure 6:
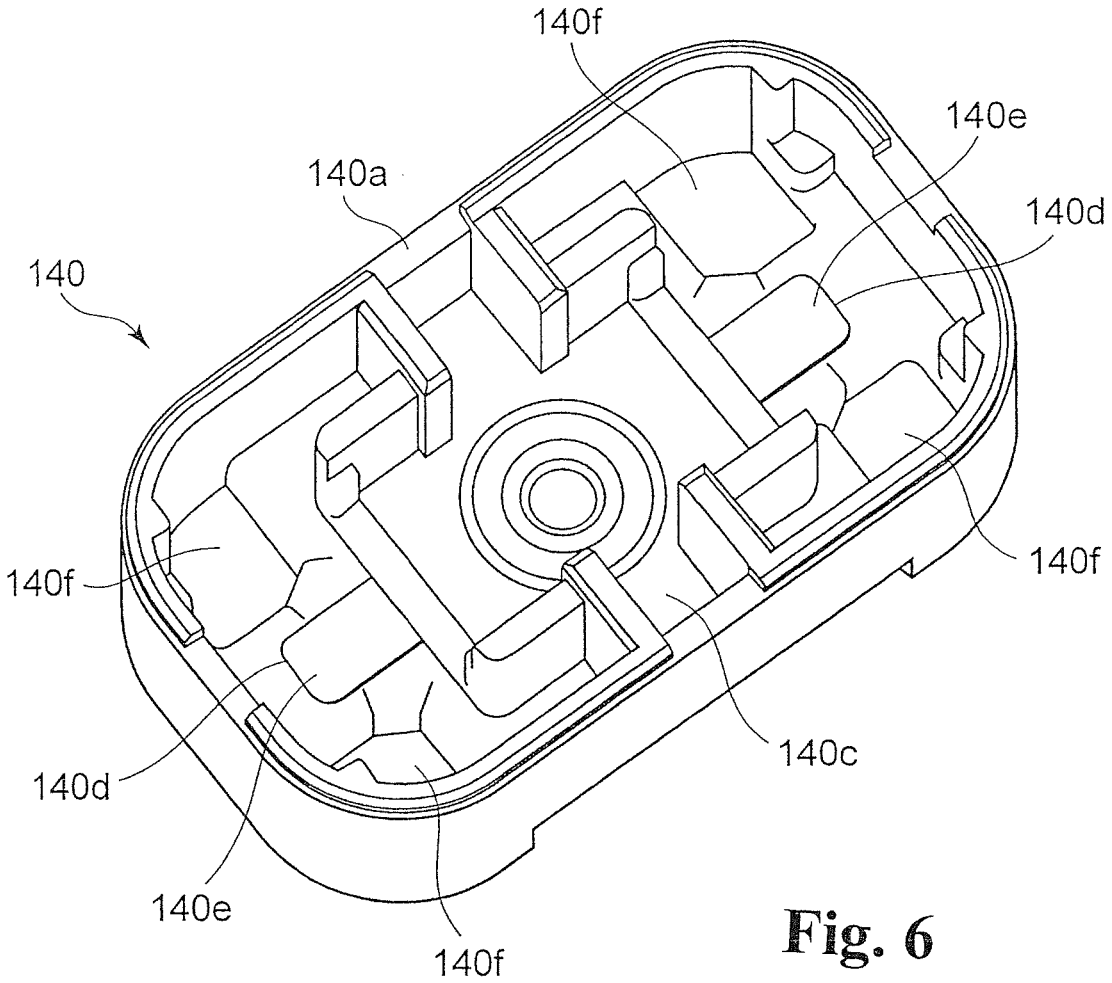
FIG. 6 is a perspective view showing an insulating cylinder.

Furthermore, an insulating cylinder 140, formed in a bottomed tubular form of a tubular portion 140*a* and a bottom plate portion 140*b* formed on the lower surface side of the tubular portion 140*a*, as shown in FIG. 1, FIG. 3, and FIG. 6, is disposed on the inner peripheral surface of the tubular body 104 of the contact housing case 102.

The insulating cylinder 140 is made of, for example, a synthetic resin, and the tubular portion 140*a* and bottom plate portion 140*b* are formed integrally. The bottom plate portion 140*b*, as shown in FIG. 6, includes a central depressed portion 140*c*, which holds a peripheral flange 216 of the movable plunger 215 on the lower surface side thereof, to be described hereafter, and narrow depressed portions 140*d*, adjacent to the depressed portion 140*c*, that house projecting portions 220*a* of a permanent magnet 220, to be described hereafter, and projecting portions 225*a* for positioning an auxiliary yoke 225. The upper surfaces of the depressed portions 140*d* are bearing surfaces 140*e* that bear the bottom surface side of the contact portions 118*a* of the fixed contacts 111 and 112. Furthermore, arc extinguishing portions 140*f* that form the deepest portions approaching the upper magnetic yoke 210, to be described hereafter, are formed in the four corners of the bottom plate portion 140*b* of the insulating cylinder 140.

Figure 7:
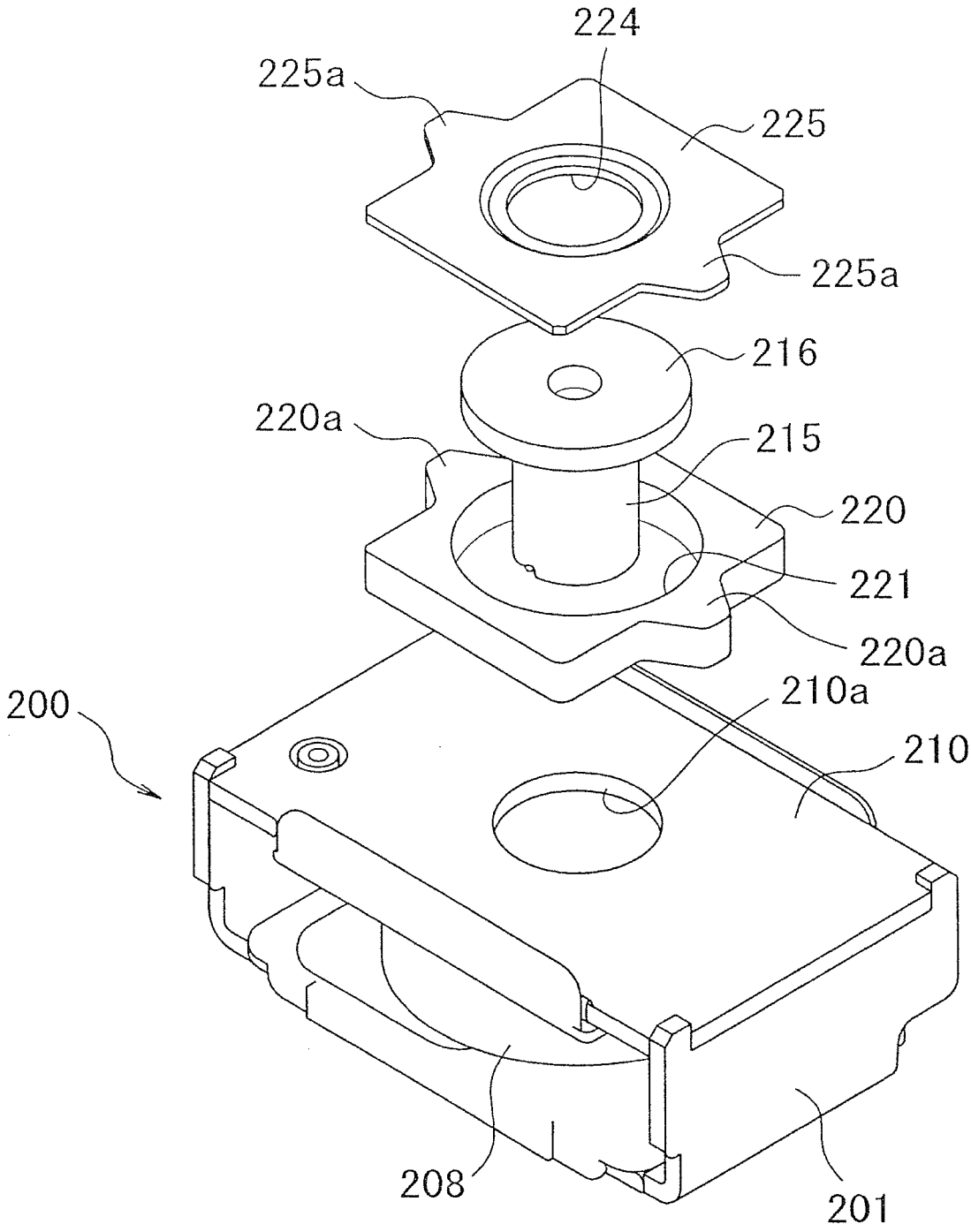
FIG. 7 is an exploded perspective view of an electromagnet unit.

The electromagnet unit 200, as shown in FIG. 1 and FIG. 7, includes a magnetic yoke 201 having a flattened U-shape in the side view thereof, and a cylindrical auxiliary yoke 203 is fixed in a central portion of a bottom plate portion 202 of the magnetic yoke 201. A spool 204 is disposed on the outer side of the cylindrical auxiliary yoke 203.

The spool 204 includes a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from the upper end of the central cylinder portion 205. Further, an exciting coil 208 is mounted and wound in a housing space formed of the central cylinder portion 205, lower flange portion 206, and upper flange portion 207.

Further, the upper magnetic yoke 210 is fixed between upper ends forming an opened end of the magnetic yoke 201. A through hole 210*a* opposing the central cylinder portion 205 of the spool 204 is formed in a central portion of the upper magnetic yoke 210.

Further, the movable plunger 215, in which a return spring 214 is disposed between a bottom portion and the bottom plate portion 202 of the magnetic yoke 201, is disposed in the central cylinder portion 205 of the spool 204 so as to be able to slide up and down. The peripheral flange portion 216, protruding outward in a radial direction on an upper end portion protruding upward from the upper magnetic yoke 210, is formed on the movable plunger 215.

Also, a permanent magnet 220 formed in a ring form, for example, having a rectangular shape at an external form thereof and a circular central aperture 221 is fixed to the upper surface of the upper magnetic yoke 210 so as to enclose the peripheral flange portion 216 of the movable plunger 215. The permanent magnet 220 is magnetized in an up-down direction, that is, a thickness direction, such that the upper end side is, for example, an N-pole while the lower end side is an S-pole. The positioning projecting portions 220*a* are formed on both side surfaces of the permanent magnet 220 opposing the movable contact 130. The form of the central aperture 221 of the permanent magnet 220 is tailored to the form of the peripheral flange portion 216, while the form of the outer peripheral surface can be an arbitrary form such as circular or rectangular.

Further, an auxiliary yoke 225 having the same external form as the permanent magnet 220, and a through hole 224 of an inner diameter smaller than the outer diameter of the peripheral flange portion 216 of the movable plunger 215, is fixed to the upper end surface of the permanent magnet 220. The positioning projecting portions 225*a* are formed to correspond to the positioning projecting portions 220*a* of the permanent magnet 220 on the auxiliary yoke 225, as shown in FIG. 7. The peripheral flange portion 216 of the movable plunger 215 is brought into contact with the lower surface of the auxiliary yoke 225.

Also, the connecting shaft 131 that supports the movable contact 130 is screwed to the upper end surface of the movable plunger 215.

Further, the movable plunger 215 is covered with a cap 230 made of a non-magnetic body and formed in a bottomed tubular form, and a flange portion 231 formed to extend outward in a radial direction on an opened end of the cap 230 is seal-joined to the lower surface of the upper magnetic yoke 210. Because of this, a hermetic receptacle, wherein the contact housing case 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described embodiment.

Herein, it is assumed that the fixed contact 111 is connected to, for example, a power supply source that supplies a large current, while the fixed contact 112 is connected to a load.

In this state, the exciting coil 208 in the electromagnet unit 200 is in a non-exciting state, and is in a released state wherein no exciting force to descend the movable plunger 215 is being generated in the electromagnet unit 200.

In this released state, the movable plunger 215 is biased in an upward direction away from the upper magnetic yoke 210 by the return spring 214. Simultaneously with this, a suctioning force created by the magnetic force of the permanent magnet 220 acts on the auxiliary yoke 225, and the peripheral flange portion 216 of the movable plunger 215 is suctioned. Because of this, the upper surface of the peripheral flange portion 216 of the movable plunger 215 is brought into contact with the lower surface of the auxiliary yoke 225.

In this state, the contact portions 130*a* of the movable contact 130 of the contact mechanism 101 linked to the movable plunger 215 via the connecting shaft 131 are separated by a predetermined distance upward from the contact portions 118*a* of the fixed contacts 111 and 112. Because of this, the current path between the fixed contacts 111 and 112 is in an interrupted state, and the contact mechanism 101 is in an opened contact state.

In this way, as both the biasing force of the return spring 214 and the suctioning force of the annular permanent magnet 220 act on the movable plunger 215 when the electromagnet unit 200 is in the released state, there is no downward movement of the movable plunger 215, inadvertently caused, due to vibration, shock, or the like, from the exterior, and it is thus possible to reliably prevent malfunction.

On the exciting coil 208 of the electromagnet unit 200 excited in the released state, an exciting force is generated in the electromagnet unit 200, and the movable plunger 215 is pressed downward against the biasing force of the return spring 214 and the suctioning force of the annular permanent magnet 220.

Further, the movable plunger 215 descends swiftly against the biasing force of the return spring 214 and the suctioning force of the annular permanent magnet 220. The descent of the movable plunger 215 is stopped by the lower surface of the peripheral flange portion 216 contacting with the upper surface of the upper magnetic yoke 210.

By descending the movable plunger 215 in this way, the movable contact 130 linked to the movable plunger 215 via the connecting shaft 131 also descends, and the contact portions 130*a* come into contact with the contact portions 118*a* of the fixed contacts 111 and 112 at the contact pressure of the contact spring 134.

Because of this, the contact mechanism 101 is in a closed contact state wherein the large current of the external power supply source is supplied via the fixed contact 111, movable contact 130, and fixed contact 112 to the load.

When interrupting the supply of current to the load in the closed contact state of the contact mechanism 101, the exciting of the exciting coil 208 of the electromagnet unit 200 is stopped.

Because of this, there is no longer an exciting force moving the movable plunger 215 downward in the electromagnet unit 200, as a result, the movable plunger 215 is raised by the biasing force of the return spring 214, and the suctioning force of the annular permanent magnet 220 becomes large as the peripheral flange portion 216 comes close to the auxiliary yoke 225.

By raising the movable plunger 215, the movable contact 130 linked via the connecting shaft 131 rises. As a result of this, the movable contact 130 is in contact with the fixed contacts 111 and 112 while the contact pressure is applied by the contact spring 134. Subsequently, an opened contact state, wherein the movable contact 130 moves upward away from the fixed contacts 111 and 112, when the contact pressure of the contact spring 134 stops, is started.

On the opened contact state, an arc is generated between the contact portions 118*a* of the fixed contacts 111 and 112 and the contact portions 130*a* of the movable contact 130, and the state in which current is conducted is continued owing to the arc. At this time, the insulating cover 121 is mounted to cover the upper plate portion 116 and intermediate plate portion 117 of the C-shaped portions 115 of the fixed contacts 111 and 112. Because of this, it is possible to generate the arc only between the contact portions 118*a* of the fixed contacts 111 and 112 and the contact portions 130*a* of the movable contact 130. As a result of this, it is possible to stabilize the arc generation state by reliably preventing the arc from moving above the C-shaped portions 115 of the fixed contacts 111 and 112, and thus possible to improve arc extinguishing performance. Moreover, as both side surfaces of the fixed contacts 111 and 112 are also covered by the insulating cover 121, it is also possible to reliably prevent the leading end of the arc from short-circuiting.

Also, the upper plate portion 116 and intermediate plate portion 117 of the C-shaped portion 115 are covered by the insulating cover 121. Because of this, it is possible to maintain, by the insulating cover 121, an insulating distance between the two end portions of the movable contact 130 and the upper plate portion 116 and intermediate plate portion 117 of the C-shaped portions 115, and thus possible to reduce the height in the direction which the movable contact 130 can move. Consequently, it is possible to reduce the size of the contact device 100.

Furthermore, the insulating cover 121 has the extended portions 126 extending integrally with the side plate portions 123 and 124 to the sides opposite to those of the fitting portions 125, and the extended portions 126 cover the inner surface of the fixed contact support insulating base plate 105, as shown in FIG. 3. Because of this, an arc 150 generated between the movable contact 130 and fixed contacts 111 and 112 is considerably extended and extinguished in arc extinguishing spaces 151 formed to the sides of the arc 150, as shown in FIG. 3, and it is thus possible to improve interruption performance. Herein, the arc extinguishing spaces 151 are formed of the side plate portions 123 and 124 and extended portions 126 of the insulating cover 121, the tubular portion 140*a* of the insulating cylinder 140, and the arc extinguishing portions 140*f* formed in the bottom plate portion 140*b*, and are completely enclosed without exposing metal portion. Because of this, it is possible to reliably prevent the arc from reaching the support conductor portions 114 or C-shaped portions 115 of the fixed contacts 111 and 112, and thus possible to reliably avoid a state wherein the arc comes into contact between the arc extinguishing spaces 151 and the metal portions, and short-circuits.

Furthermore, the insulating cover 121 can be mounted on the fixed contacts 111 and 112 simply by the fitting portions 125 fitted onto the small diameter portions 114*b* of the fixed contacts 111 and 112, and mounting onto the fixed contacts 111 and 112 can thus be easily carried out.

In the heretofore described embodiment, a description has been given of a case in which the contact housing case 102 of the contact mechanism 100 includes the tubular body 104 and fixed contact support insulating base plate 105, but this is not limited to this, and other configurations can be adopted. For example, as shown in FIG. 2(*b*), the configuration may be formed such that a tubular portion 301 and an upper surface plate portion 302 closing off the upper end of the tubular portion 301 are formed integrally of a ceramic or a synthetic resin material, thereby forming a tub-form body 303, a metal foil is formed on an opened end surface side of the tub-form body 303 by a metalizing process, and a metal connection member 304 is seal-joined to the metal foil, thus forming the contact housing case 102.

Figure 8A:
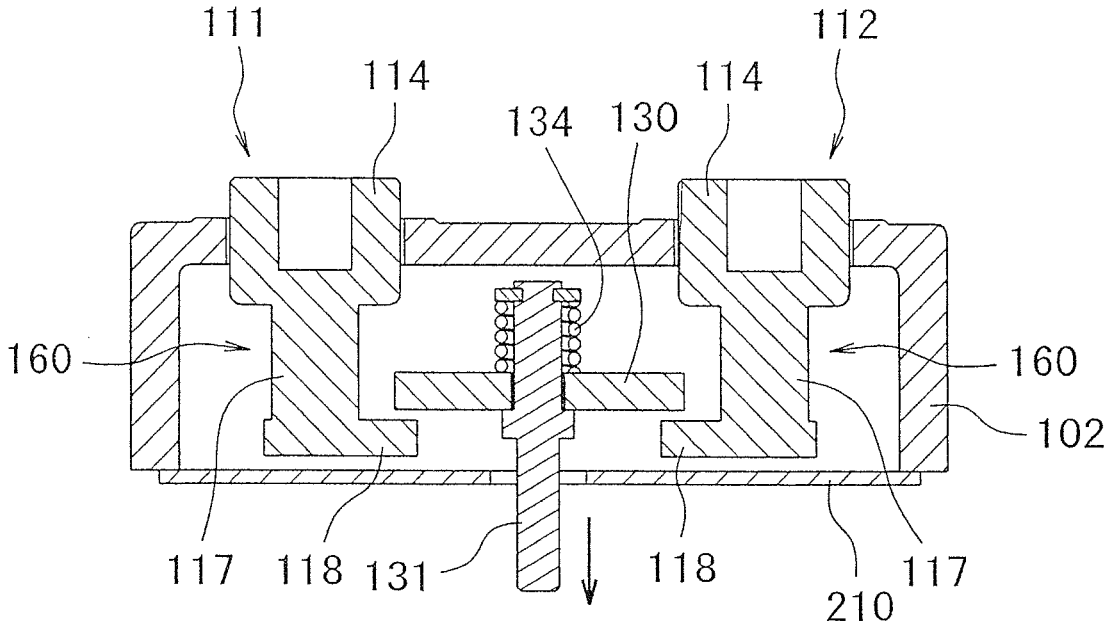
FIGS. 8(*a*) and 8(*b*) are diagrams, each showing a modification example of a contact device of the invention, wherein FIG. 8 (*a*) is a sectional view and FIG. 8(*b*) is a perspective view.
Figure 8B:
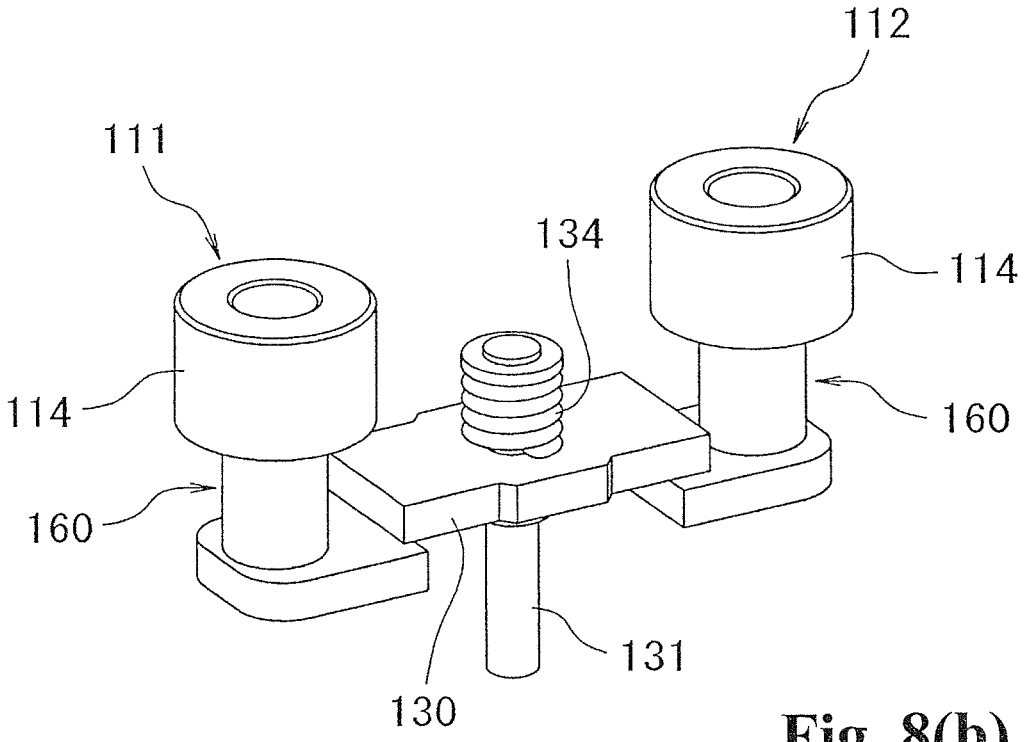

Also, in the heretofore described embodiment, a description has been given of a case in which the C-shaped portion 115 is formed in the fixed contacts 111 and 112, but this is not limited to this, and the configuration adopted may be formed such that an L-shaped portion 160, formed such that the upper plate portion 116 in the C-shaped portion 115 is omitted, is linked to the support conductor portion 114, as shown in FIGS. 8 (*a*) and (*b*). In this case, the insulating cover 121 is mounted so as to cover the lower surface of the support conductor portion 114 and the intermediate plate portion 117.

Figure 9A:
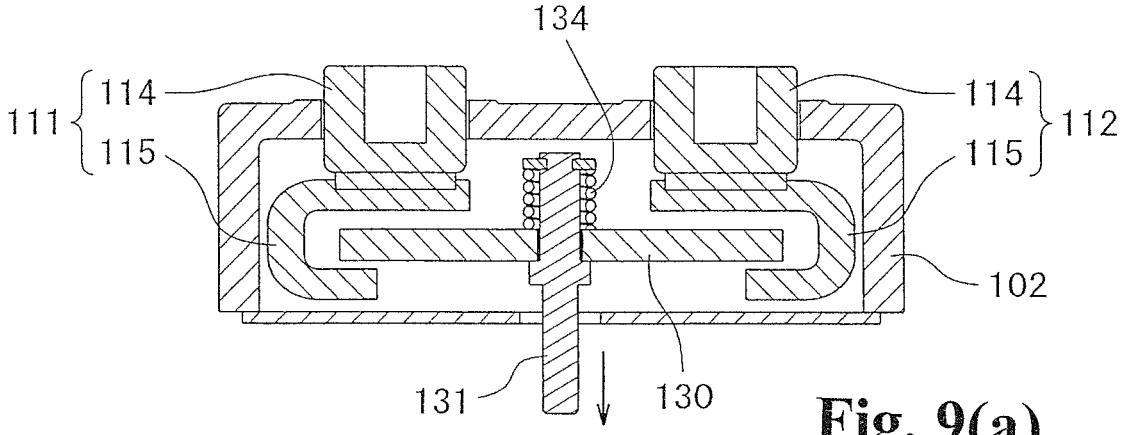
FIGS. 9(*a*) and 9(*b*) are diagrams, each showing another modification example of the contact device of the invention, wherein FIG. 9(*a*) is a sectional view and FIG. 9(*b*) is a perspective view.
Figure 9B:
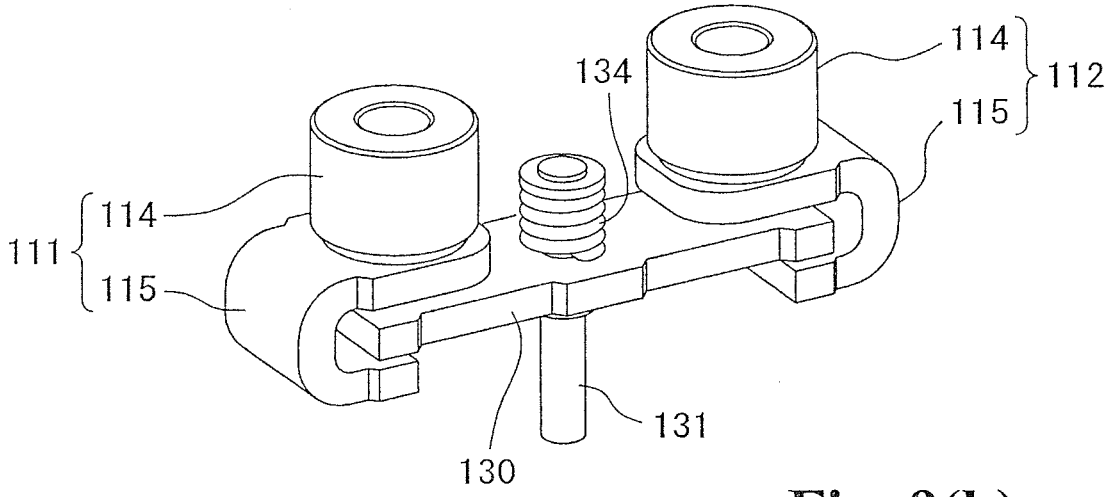

Also, in the heretofore described embodiment, a description has been given of a case in which the movable contact 130 has the depressed portion 132 in a central portion, but this is not limited to this, and the depressed portion 132 may be omitted to form a flat plate, as shown in FIGS. 9(*a*) and (*b*).

Also, in the heretofore described embodiment, a description has been given of a case in which the connecting shaft 131 is screwed to the movable plunger 215, but the movable plunger 215 and connecting shaft 131 may also be formed integrally.

Also, a description has been given of a case in which the linking of the connecting shaft 131 and movable contact 130 is formed such that the flange portion 131*a* is formed on the leading end portion of the connecting shaft 131, and the lower end of the movable contact 130 is fixed with a C-ring after the connecting shaft 131 is inserted through the contact spring 134 and movable contact 130, but this is not limited to this. That is, a positioning large diameter portion may be formed protruding in a radial direction in the C-ring position of the connecting shaft 131, the contact spring 134 disposed after the movable contact 130 is brought into contact with the large diameter portion, and the upper end of the contact spring 134 fixed with the C-ring.

Also, the configuration of the electromagnet unit 200 is not limited to the configuration in the heretofore described embodiment, that is, it is possible to apply an arbitrary configuration.

Also, in the heretofore described embodiment, a description has been given of a case in which a hermetic receptacle is formed of the contact housing case 102 and cap 230, and gas is encapsulated inside the hermetic receptacle, but this is not limited to this, the gas encapsulation may be omitted when the interrupted current is small.

What is claimed is:

1. An electromagnetic contactor, comprising:

a contact device including a pair of fixed contacts disposed to maintain a predetermined distance and a movable contact disposed so as to contact to and detach from the pair of fixed contacts, the pair of fixed contacts including support conductor portions supported to maintain a predetermined interval on an upper surface of a contact housing case, and C-shaped portions formed in a C-shape and opened to form openings facing each other, the each of the C-shaped portions having an upper plate portion linked to an end portion a first support conductor portion of the support conductor portions inside the contact housing case, an intermediate plate portion extending downward from a side of the upper plate portion opposite to a side of a second support conductor portion of the support conductor portions, and a lower plate portion extending from a lower end of the intermediate plate portion to the second support conductor portion side and having a contact portion formed on an upper surface thereof; and insulating covers mounted on the pair of fixed contacts, and covering the pair of fixed contacts except for the contact portions that contact the movable contact, and an inner surface of an insulating plate that fixes and holds the pair of fixed contacts, the insulating cover including a cover main body exposing at least the contact portion of the C-shaped portion and covering a lower surface and side surfaces of the upper plate portion, and extended portions extending along the inner surface of the insulating plate from side surface portions of the cover main body that cover the side surfaces of the upper plate portion.

2. The electromagnetic contactor according to claim 1, wherein the cover main body includes an L-shaped portion covering the lower surface of the upper plate portion and an inner surface of the intermediate plate portion, and side plate portions extending from side edges of the L-shaped portion and covering the side surfaces of the upper plate portion and side surfaces of the intermediate plate portion, and the extended portions extend from upper ends of the side plate portions along the inner surface of the insulating plate to cover the inner surface of the insulating plate.

3. The electromagnetic contactor according to claim 1, further comprising an insulating cylinder including a tubular portion and a bottom plate portion integrally formed with the tubular portion, wherein the side surface portions and the extended portions of the insulating cover and the tubular portion and the bottom plate portion of the insulating cylinder form arc extinguishing spaces, and the tubular portion covers side portions of the arc extinguishing spaces, and the bottom plate portion covers bottom portions of the arc extinguishing spaces, entirely.

4. An electromagnetic contactor, comprising:

a contact device including a pair of fixed contacts disposed to maintain a predetermined distance and a movable contact disposed so as to contact to and detach from the pair of fixed contacts, wherein an insulating cover, which covers the pair of fixed contacts except for contact portions that contact the movable contact and covers an inner surface of an insulating plate that fixes and holds the fixed contacts, is mounted on the pair of fixed contacts;

the pair of fixed contacts includes support conductor portions supported to maintain a predetermined interval on an upper surface of a contact housing case, and C-shaped portions formed in a C-shape, each having an upper plate portion linked to an end portion a first support conductor portion of the support conductor portions inside the contact housing case, an intermediate plate portion extending downward from a side of the upper plate portion opposite to a side of a second support conductor portion of the support conductor portions, and a lower plate portion extending from a lower end of the intermediate plate portion to the second support conductor portion side and having at least a first contact portion of the contact portions formed on an upper surface thereof;

the insulating cover includes cover main bodies, which expose at least the contact portions of the C-shaped portions and cover surfaces opposing the movable contact and side surfaces adjacent to each of the surfaces opposing the movable contact, and extended portions extending along a line of the inner surface of the insulating plate from side surface portions of each of the cover main bodies that cover side surfaces of each of the upper plate portions; and the insulating cover includes L-shaped portions that cover inner surfaces of the upper plate portions and the intermediate plate portions of the C-shaped portions of the pair of fixed contacts, side plate portions extending from side edges of the L-shaped portions so as to cover side surfaces of the C-shaped portions, fitting portions extending inward from upper ends of the side plate portions opposing the support conductor portions and fitted onto small diameter portions formed on the support conductor portions, and the extended portions extending from the upper ends of the side plate portions along the inner surface of the insulating plate, respectively.

* * * * *